US008282250B1

(12) United States Patent
Dassanayake et al.

(10) Patent No.: US 8,282,250 B1
(45) Date of Patent: Oct. 9, 2012

(54) SOLID STATE LIGHTING DEVICE USING HEAT CHANNELS IN A HOUSING

(75) Inventors: Mahendra Dassanayake, Bloomfield Hills, MI (US); Hiranthini Alles, Livonia, MI (US)

(73) Assignee: eLumigen LLC, Auburn Hills, MI (US)

( * ) Notice: Subject to any disclaimer, the term of this patent is extended or adjusted under 35 U.S.C. 154(b) by 0 days.

(21) Appl. No.: 13/492,177

(22) Filed: Jun. 8, 2012

Related U.S. Application Data

(60) Provisional application No. 61/495,117, filed on Jun. 9, 2011.

(51) Int. Cl.
*F21V 29/00* (2006.01)

(52) U.S. Cl. ..... 362/373; 362/249.02; 362/294

(58) Field of Classification Search ..... 362/218, 362/231, 235, 244, 245, 249.01, 249.02, 362/249.11, 294, 311.01, 311.02, 326, 327, 362/329, 363, 373, 650, 800; 313/499–500, 313/512

See application file for complete search history.

(56) References Cited

U.S. PATENT DOCUMENTS

| | | | |
|---|---|---|---|
| 4,727,289 | A | 2/1988 | Uchida |
| 5,132,875 | A | 7/1992 | Plesinger |
| 5,654,587 | A | 8/1997 | Schneider et al. |
| 6,019,493 | A | 2/2000 | Kuo et al. |
| 6,045,240 | A | 4/2000 | Hochstein |
| 6,149,283 | A | 11/2000 | Conway et al. |
| 6,538,892 | B2 | 3/2003 | Smalc |
| 6,659,632 | B2 | 12/2003 | Chen |
| 6,688,753 | B2 | 2/2004 | Calon et al. |
| 6,767,111 | B1 | 7/2004 | Lai |
| D494,687 | S | 8/2004 | Matsui et al. |
| 6,820,998 | B2 | 11/2004 | Chen |
| 6,827,475 | B2 | 12/2004 | Vetorino et al. |
| 6,840,654 | B2 | 1/2005 | Guerrieri et al. |
| 6,864,513 | B2 | 3/2005 | Lin et al. |
| 6,948,829 | B2 | 9/2005 | Verdes et al. |

(Continued)

FOREIGN PATENT DOCUMENTS

CN 2444117 Y 8/2001

(Continued)

OTHER PUBLICATIONS

FL7730 Single-State Primary-Side-Regulation PWM Controller for PFC and LED Dimmable Driving; 2011 Fairchild Semiconductor Corporation; www.fairchildsemi.com; pp. 1-13.

*Primary Examiner* — Hargobind S Sawhney
(74) *Attorney, Agent, or Firm* — Harness, Dickey & Pierce, P.L.C.

(57) ABSTRACT

A light assembly includes a cover, a base and a housing coupled between the housing and the base. A first circuit board is disposed within the housing. The first circuit board has a plurality of light sources thereon. The housing comprises an inner wall defining a first volume therein and an outer wall spaced apart from the inner wall. The housing comprises a plurality of spaced apart fins extending between the inner wall and the outer wall define a plurality of channels having a first end proximate the cover and a second end proximate the base. The channels have a first cross sectional area proximate the first end greater than a second cross-sectional area proximate the second end. An elongated control circuit board assembly is electrically coupled to the light sources of the first circuit.

23 Claims, 10 Drawing Sheets

U.S. PATENT DOCUMENTS

| | | | | |
|---|---|---|---|---|
| 6,965,205 | B2 | 11/2005 | Piepgras et al. | |
| 6,982,518 | B2 | 1/2006 | Chou et al. | |
| 7,038,399 | B2 | 5/2006 | Lys et al. | |
| 7,068,512 | B2 | 6/2006 | Lee et al. | |
| 7,125,160 | B2 | 10/2006 | Wong et al. | |
| D531,740 | S | 11/2006 | Maxik | |
| D532,532 | S | 11/2006 | Maxik | |
| 7,160,012 | B2 | 1/2007 | Hilscher et al. | |
| 7,161,311 | B2 | 1/2007 | Mueller et al. | |
| 7,181,378 | B2 | 2/2007 | Benitez et al. | |
| D538,950 | S | 3/2007 | Maxik | |
| D538,952 | S | 3/2007 | Maxik et al. | |
| 7,226,189 | B2 | 6/2007 | Lee et al. | |
| 7,246,919 | B2 | 7/2007 | Porchia et al. | |
| 7,253,447 | B2 | 8/2007 | Oishi et al. | |
| D553,266 | S | 10/2007 | Maxik | |
| 7,319,293 | B2 | 1/2008 | Maxik | |
| 7,344,279 | B2 | 3/2008 | Mueller et al. | |
| D566,309 | S | 4/2008 | Kornfeld et al. | |
| D566,323 | S | 4/2008 | Piepgras et al. | |
| 7,350,936 | B2 | 4/2008 | Ducharme et al. | |
| 7,352,138 | B2 | 4/2008 | Lys et al. | |
| 7,358,679 | B2 | 4/2008 | Lys et al. | |
| 7,367,692 | B2 | 5/2008 | Maxik | |
| 7,375,476 | B2 | 5/2008 | Walter et al. | |
| 7,396,142 | B2 | 7/2008 | Laizure, Jr. et al. | |
| 7,401,948 | B2 | 7/2008 | Chinniah et al. | |
| 7,445,340 | B2 | 11/2008 | Conner et al. | |
| D584,838 | S | 1/2009 | To et al. | |
| 7,482,632 | B2 | 1/2009 | Lu et al. | |
| 7,497,596 | B2 | 3/2009 | Ge | |
| 7,520,634 | B2 | 4/2009 | Ducharme et al. | |
| 7,521,875 | B2 | 4/2009 | Maxik | |
| 7,524,089 | B2 | 4/2009 | Park | |
| 7,527,397 | B2 | 5/2009 | Li | |
| 7,540,616 | B2 | 6/2009 | Conner | |
| 7,547,894 | B2 | 6/2009 | Agrawal et al. | |
| 7,575,346 | B1 * | 8/2009 | Horng et al. | 362/373 |
| 7,604,378 | B2 | 10/2009 | Wolf et al. | |
| 7,607,802 | B2 | 10/2009 | Kang et al. | |
| D604,434 | S | 11/2009 | Wada et al. | |
| 2003/0021117 | A1 | 1/2003 | Chan | |
| 2005/0094401 | A1 | 5/2005 | Magarill | |
| 2005/0173675 | A1 | 8/2005 | Schmidt et al. | |
| 2006/0098440 | A1 | 5/2006 | Allen | |
| 2006/0238136 | A1 | 10/2006 | Johnson, III et al. | |
| 2006/0262544 | A1 | 11/2006 | Piepgras et al. | |
| 2007/0139938 | A1 | 6/2007 | Petroski et al. | |
| 2007/0165408 | A1 | 7/2007 | Li | |
| 2008/0013334 | A1 | 1/2008 | Lu et al. | |
| 2008/0093998 | A1 | 4/2008 | Dennery et al. | |
| 2008/0106893 | A1 | 5/2008 | Johnson et al. | |
| 2008/0232119 | A1 | 9/2008 | Ribarich | |
| 2008/0295522 | A1 | 12/2008 | Hubbell et al. | |
| 2008/0310158 | A1 | 12/2008 | Harbers et al. | |
| 2009/0001399 | A1 | 1/2009 | Diana et al. | |
| 2009/0059559 | A1 | 3/2009 | Pabst et al. | |
| 2009/0302237 | A1 | 12/2009 | Bortz et al. | |
| 2010/0010701 | A1 | 1/2010 | Gärtner | |
| 2010/0020538 | A1 | 1/2010 | Schulz et al. | |
| 2010/0103666 | A1 | 4/2010 | Chang et al. | |
| 2010/0103669 | A1 | 4/2010 | Yang et al. | |
| 2010/0103671 | A1 | 4/2010 | Zheng | |
| 2010/0110683 | A1 | 5/2010 | Fang et al. | |
| 2010/0110687 | A1 | 5/2010 | Zheng | |
| 2010/0118537 | A1 | 5/2010 | Shin | |
| 2010/0135012 | A1 | 6/2010 | Lee | |
| 2012/0188775 | A1 * | 7/2012 | Chuang | 362/373 |

FOREIGN PATENT DOCUMENTS

| | | |
|---|---|---|
| DE | 1 566 447 | 4/1980 |
| DE | 103 44 547 A1 | 8/2005 |
| EP | 1 411 290 A1 | 4/2004 |
| FR | 984.607 | 7/1951 |
| JP | 2003-31005 | 1/2003 |
| JP | 2006-156187 | 6/2006 |
| WO | WO 2004/100213 | 11/2004 |
| WO | WO 2007/067513 | 6/2007 |
| WO | WO 2009/063655 | 5/2009 |

* cited by examiner

FIG. 2A
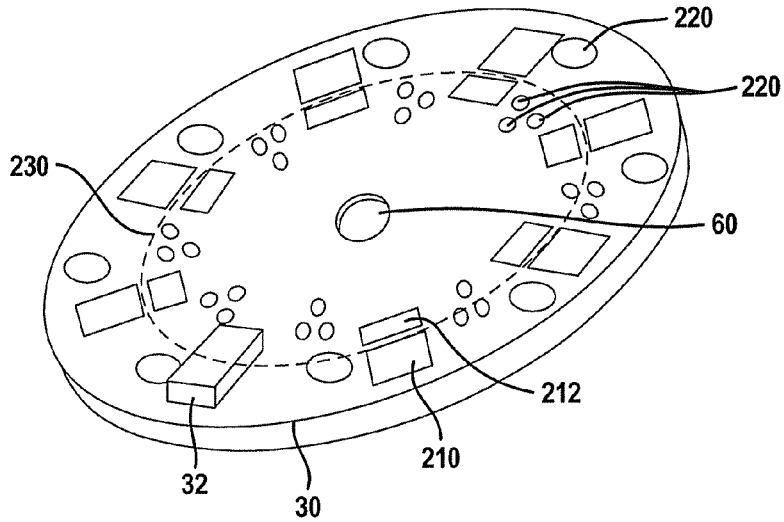
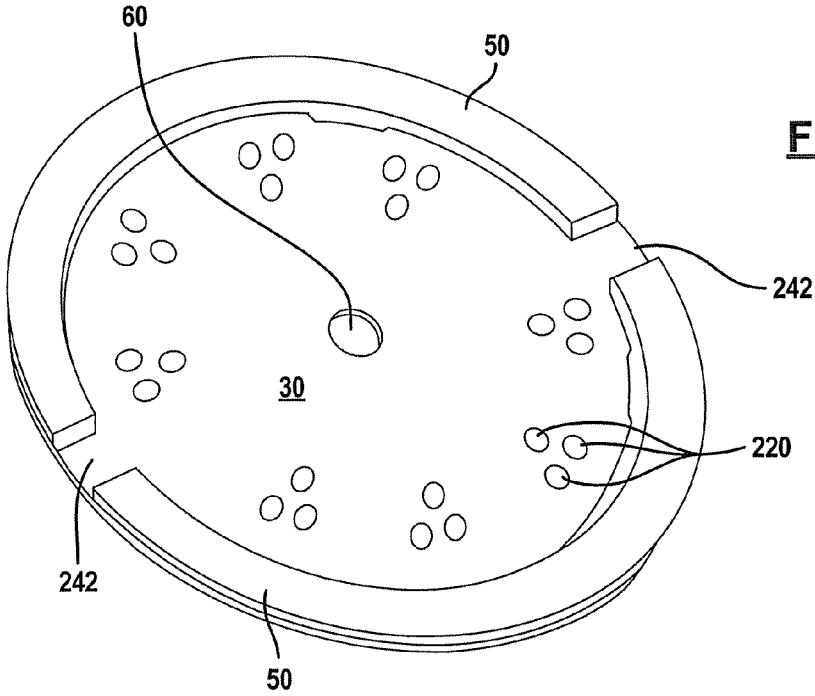
FIG. 2B

SOLID STATE LIGHTING DEVICE USING HEAT CHANNELS IN A HOUSING

CROSS-REFERENCE TO RELATED APPLICATIONS

This application claims the benefit of U.S. Provisional Application No. 61/495,117, filed on Jun. 9, 2011. The entire disclosure of the above application is incorporated herein by reference.

TECHNICAL FIELD

The present disclosure relates generally to lighting using solid state light sources such as light-emitting diodes or lasers and, more specifically, to lighting devices for various applications that use heat channels to remove heat to provide an energy-efficient long-lasting life source.

BACKGROUND

This section provides background information related to the present disclosure which is not necessarily prior art.

Providing alternative light sources is an important goal to reduce energy consumption. Alternatives to incandescent bulbs include compact fluorescent bulbs and light-emitting diode (LED) light bulbs. The compact fluorescent light bulbs use significantly less power for illumination. However, the materials used in compact fluorescent bulbs are not environmentally friendly.

Various configurations are known for light-emitting diode lights. Light-emitting diode lights last longer and have less environmental impact than compact fluorescent bulbs. Light-emitting diode lights use less power than compact fluorescent bulbs. However, many compact fluorescent bulbs and light-emitting diode lights do not have the same light spectrum as incandescent bulbs. They are also relatively expensive. In order to achieve maximum life from a light-emitting diode, heat must be removed from around the light-emitting diode. In many known configurations, light-emitting diode lights are subject to premature failure due to heat and light output deterrents with increased temperature.

SUMMARY

This section provides a general summary of the disclosure, and is not a comprehensive disclosure of its full scope or all of its features.

The present disclosure provides a lighting assembly that is used for generating light and providing a long-lasting and thus cost-effective unit.

In one aspect of the disclosure, a light assembly includes a cover, a base and a housing coupled between the housing and the base. A first circuit board is disposed within the housing. The first circuit board has a plurality of light sources thereon. The housing comprises an inner wall defining a first volume therein and an outer wall spaced apart from the inner wall. The housing comprising a plurality of spaced apart fins extending between the inner wall and the outer wall define a plurality of channels having a first end proximate the cover and a second end proximate the base. The channels have a first cross sectional area proximate the first end greater than a second cross-sectional area proximate the second end. An elongated control circuit board assembly is electrically coupled to the light sources of the first circuit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected examples and not all possible implementations, and are not intended to limit the scope of the present disclosure.

FIGS. 2A and 2B are perspective views of a circuit board formed according to the present disclosure;

Corresponding reference numerals indicate corresponding parts throughout the several views of the drawings.

DETAILED DESCRIPTION

Figure 1:
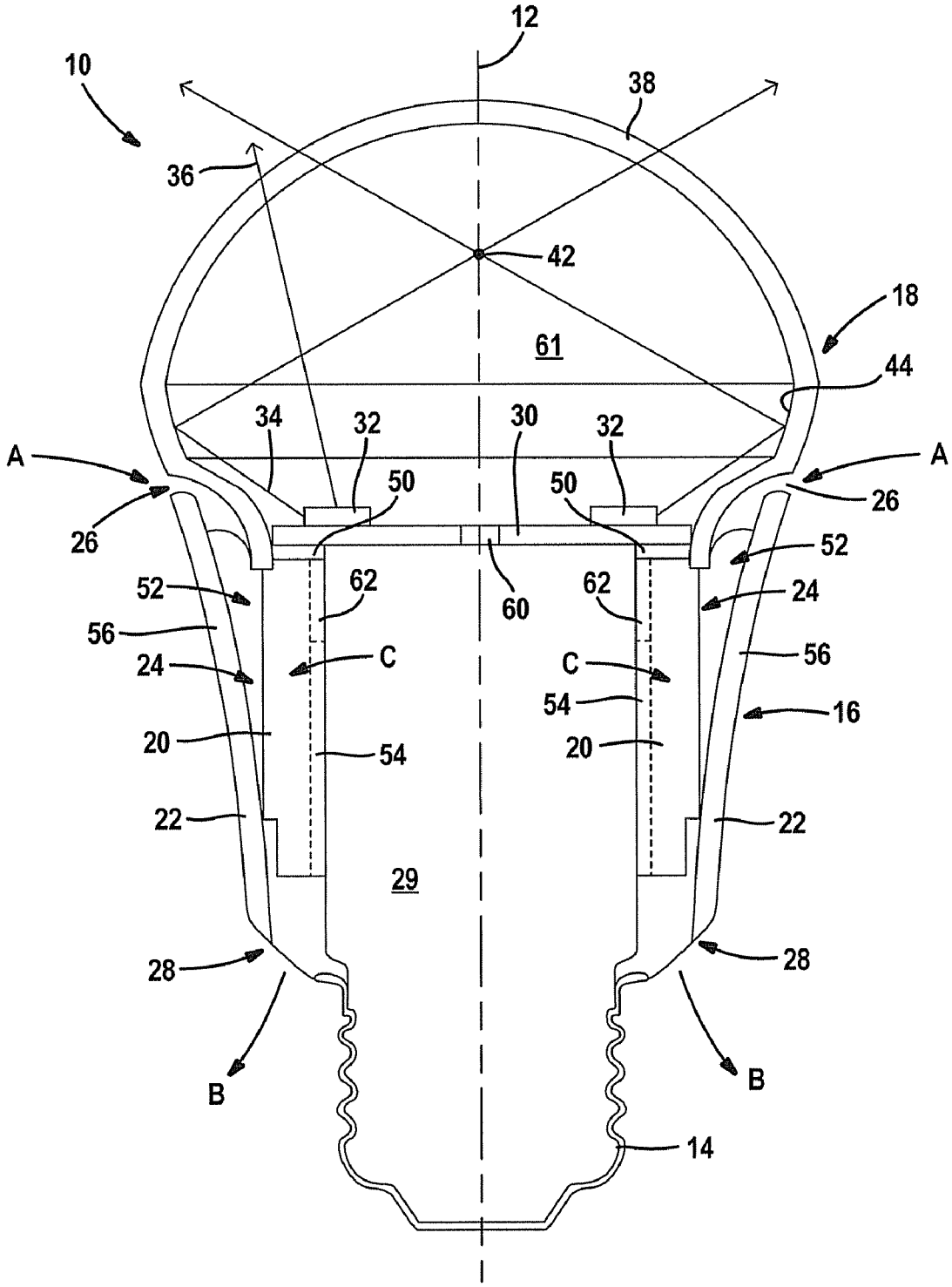
FIG. 1 is a cross-sectional view of a first example of a lighting assembly according to the present disclosure.

The following description is merely exemplary in nature and is not intended to limit the present disclosure, application, or uses. For purposes of clarity, the same reference numbers will be used in the drawings to identify similar elements. As used herein, the phrase "at least one of A, B, and C" should be construed to mean a logical (A or B or C), using a non-exclusive logical OR. It should be understood that steps within a method may be executed in different order without altering the principles of the present disclosure.

It should be noted that in the following figures various components may be used interchangeably. For example, several different examples of control circuit boards and light source circuit boards are implemented. As well, various shapes of light redirection elements may also be used. Various combinations of heat sinks, control circuit boards, light source circuit boards, and shapes of the light assemblies may be used. Various types of printed traces and materials may also be used interchangeably in the various examples of the light assembly.

In the following figures, a lighting assembly is illustrated having various examples that include solid state light sources such as light-emitting diodes (LEDs) and solid state lasers with various wavelengths. Different numbers of light sources and different numbers of wavelengths may be used to form a desired light output depending upon the ultimate use for the light assembly. The light assembly provides an opto-thermal solution for a light device.

Referring now to FIG. 1, a cross-section of a light assembly 10 is illustrated. Light assembly 10 may be rotationally symmetric around a longitudinal axis 12. The light assembly 10 includes a lamp base 14, a housing 16, and a cover 18. The lamp base or base 14 is used for providing electricity to the bulb. The base 14 may have various shapes depending upon the application. The shapes may include a standard Edison base, or various other types of larger or smaller bases. The base 14 may be various types including screw-in, clip-in or plug-in. The base 14 may be at least partially made from metal for making electrical contact and may also be used for thermal heat conduction and dissipation. The base 14 may also be made from material not limited to ceramic, thermally conductive plastic, plastic with molded circuit connectors, or the like.

The housing 16 is adjacent to the base 14. The housing 16 may be directly adjacent to the base 14 or have an intermediate portion therebetween. The housing 16 may be formed of a metal or other heat-conductive material such a thermally conductive plastic, plastic or combinations thereof. One example of a suitable metal is aluminum. The housing 16 may be formed in various ways including stamping, extrusion, plastic molding such as over-molding or combinations thereof. Another way of forming the housing 16 includes injected-molded metals such as Zylor®. Thicksoform® molding may also be used. In one constructed example the housing 16 was formed with a first portion 20 and a second portion 22. The first portion 20 is formed of an aluminum material and the second portion 22 is formed at least partially of thermally-conductive plastic. The second portion 22 may also be formed of a portion of thermally-conductive plastic and non-thermally-conductive plastic. Thermally-conductive plastic may be used in higher temperature portions toward the lamp base while non-thermally-conductive less expensive plastic may be used in other portions of the second portion. The formation of the housing 16 will be described further below.

The housing 16 may be formed to provide an air channel 24 formed therein. The air channel 24 has a first cross-sectional area located adjacent to the cover 18 that is wider than the cross-sectional area proximate the lamp base 14. The channels 24 provide convective cooling of the housing 16 and light assembly 10. The tapered cross-sectional area provides a nozzle effect which speeds the velocity of air through the channel 24 as the channel 24 narrows. An inlet 26 to the channel 24 is provided between the second portion 22 and the cover 18. An air outlet 28 provides an outlet from the channel 24. Air from the outlet 28 is travelling at a higher speed than at the inlet 26. Arrows A indicate the direction of input air through the inlet 26 to the channels 24 and arrows B provide the outflow direction of air from the channels 24.

The plurality of channels 24 are spaced around the light assembly 10 to provide distributed cooling.

The housing 16 may define a first volume 29 within the light assembly 10. As will be described below, the first volume 29 may be used to accommodate a control circuit board or other circuitry for controlling the light-emitting diodes or other light sources therein.

The housing 16 may have various outer shapes including a hyperboloidal shape. The housing 16 may also be a free-form shape.

The housing 16 and cover 18 form an enclosure around a substrate or circuit board 30 having light sources 32. The base 14 may also be included as part of the enclosure.

The light assembly 10 includes the substrate or circuit board 30 used for supporting solid state light sources 32. The circuit board 30 may be thermally conductive and may also be made from heat sink material. Solder pads of the light sources may be thermally and/or electrically coupled to radially-oriented copper sectors or circular conductive elements over-molded onto a plastic base to assist in heat conduction. In any of the examples below, the circuit board 30 may be part of the heat sinking process.

The light sources 32 have a high lumen-per-watt output. The light sources 32 may generate the same wavelength of light or may generate different wavelengths of light. The light sources 32 may also be solid state lasers. The solid state lasers may generate collimated light. The light sources 32 may also be light-emitted diodes. A combination of different light sources generating different wavelengths may be used for obtaining a desired spectrum. Examples of suitable wavelengths include ultraviolet or blue (e.g. 450-470 nm). Multiple light sources 32 generating the same wavelengths may also be used. The light sources 32 such as light-emitting diodes generate low-angle light 34 and high-angle light 36. High-angle light 36 is directed out through the cover 18.

The cover 18 may be a partial spheroid, partial ellipsoid or combinations thereof in shape. In this example both a spheroidal portion 38 and a partial rotated ellipsoidal portion referred to as a reflector 40 are formed into the cover 18. That is, the different cover portions 38, 40 may be monolithic or integrally formed. The cover 18 may be formed of a transparent or translucent material such as glass or plastic. In one example, the cover 18 is formed of polyethylene terephthalate (PET). PET has a crystalline structure that allows heat to be transferred therethrough. Heat may be transferred form the housing 16 into the cover because of the direct contact therebetween. The spherical portion 38 of the cover 18 may be designed to diffuse light and minimize backscattered light trapped within the light assembly 10. The spheroid portion 38 of the cover 18 may be coated with various materials to change the light characteristics such as wavelength or diffusion. An anti-reflective coating may also be applied to the inside of the spheroidal portion 38 of the cover 18. A self-radiating material may also be used which is pumped by the light sources 32. Thus, the light assembly 10 may be formed to have a high color rendering index and color perception in the dark.

Often times in a typical light bulb, the low-angle light is light not directed in a working direction. Low angle light is usually wasted since it is not directed out of the fixture into which the light assembly is coupled.

The low-angle light 34 is redirected out of the cover 18 using the reflector 40. The reflector 40 may be various shapes including a paraboloid, ellipsoid, or free-formed shape. The reflector 40 may also be shaped to direct the light from the light sources 32 to a central or common point 42. The reflector 40 may have a coating for wavelength or energy shifting and spectral selection. Coating one or both of the cover 18 and the reflector 40 may be performed. Multiple coatings may also be used. The common point 42 may be the center of the spheroid portion of the cover 18.

The reflector 40 may have a reflective coating 44 used to increase the reflectivity of the reflector. However, certain materials upon forming may not require the reflective coating 44. For example, some plastics, when blow-molded, provide a shiny or reflective surface such as PET. The reflector 40 may be formed of the naturally formed reflective surface generated when blow-molding plastic.

It should be noted that when referring to various conic sections such as an ellipsoid, paraboloid or hyperboloid only a portion of the conic section that is rotated around an axis may be used for a particular surface. In a similar manner, portions of a spheroid may be used.

The circuit board 30 may be in direct contact (or indirect contact through an interface layer 50) with the housing 16, and, more specifically to the first portion 20 the housing 16. The housing 16 may include a plurality of fins 52 that extend longitudinally and radially outwardly to form the channels 24. The fins 52 may be spaced apart to allow heat to be dissipated therefrom. As will be described further below, the channels 24 may be formed between an inner wall 54 of the first portion 20, an outer wall 56 of the second portion 22 and the fins 52 that may be formed of a combination of both the first portion 20 and the second portion 22 of the housing 16.

The housing 16 may thus conduct heat away from the light sources 32 of the circuit board for dissipation outside the light assembly. The heat may be dissipated in the housing and the fins 52. Heat may also be transferred into the cover 18 directly from the housing conduction. In this manner heat may be transferred longitudinally by the housing 16 in two directly opposite directions.

The circuit board 30 may also include a port 60 for communicating air between the first volume 29 and a second volume 61 within the cover 18. Heated air that is in the cover 18 may be transmitted or communicated into the first volume 29 and through an opening 62 within the first portion 20 of the housing 16 to vent air into the channels 24. The opening 62 will be further described below.

The heated air within the cover 18 may conduct through the cover 18 and circuit board 30 to the housing as well as being communicated through the port 60.

Referring now to FIG. 2A, an example of a circuit board 30 is illustrated. The circuit board 30 includes the plurality of light sources 32 thereon. Only one light source 32 is illustrated for simplification. The circuit board 30 includes a plurality of solder pads for mounting the light source 32. Cathode solder pads 210 are illustrated as well as an anode solder pad 212. The cathode solder pads 210 and the anode solder pads 212 are located adjacent to each other in a radial position in this example. Thus, when the elongated light source 32 is disposed on the solder pads 210, 212, the light sources 32 are radially disposed. That is, the longitudinal axis of the light source 32 aligns radially with the circuit board 30. The cathode solder pads 210 may be connected in various manners depending upon the type of construction used for the circuit board 30. The interconnections of the cathode solder pad 210 are not illustrated. The cathode solder pads may remain exposed (not coated or covered) to increase thermal conduction. Likewise, the inner connections of the anode solder pads 212 also depend upon the type of construction used and thus are not illustrated.

The circuit board 30 may also include a plurality of thermal vias 220 thereon. The thermal vias 220 allow the heat from the upper layers caused from the light sources 32 to conduct heat to the bottom of the circuit board 30 and ultimately into the housing 16. The light sources 32 are disposed in a ring 230. The interaction of the ring and the reflector 40 are described further in FIG. 3.

Referring now to FIG. 2B, a simplified view of the circuit board 30 is illustrated. The circuit board 30 includes the thermally-conductive interface 50 that is used for enhancing heat transfer between the circuit board 30 and the housing 16. The thermally-conductive interface 50 may be shaped to conform to the shape of the surface of the housing 16 to which heat transfer takes place.

Openings 242 may be left in the thermally-conductive material 240 to increase flow through the opening 62 of the housing 16. Because this is an open portion, no thermal conduction takes place directly between the circuit board 30 and the housing 16. However, the thermally-conductive portion 240 may extend completely around the circuit board 30.

Figure 3A:
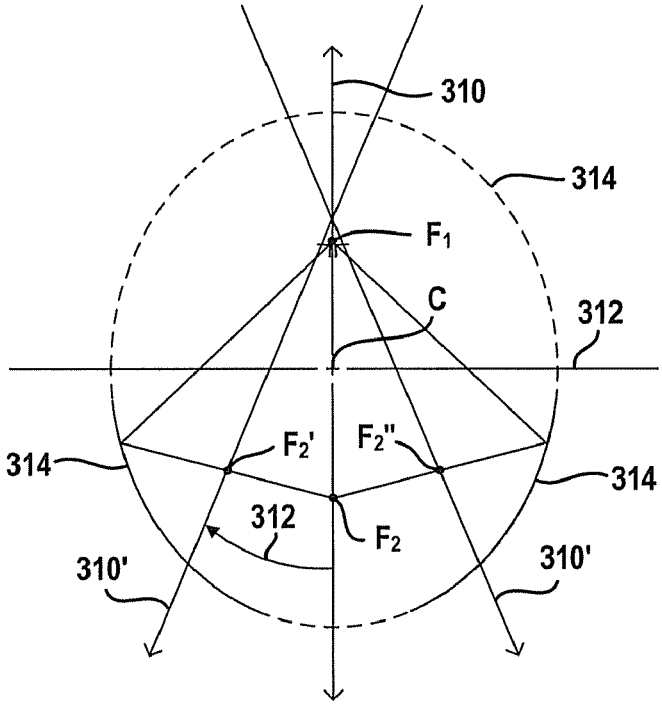
FIGS. 3A and 3B illustrate construction of the rotated partial ellipsoid forming the reflector 40.

Referring now to FIG. 3A, a method for forming the reflector 40 is set forth. The reflector 40 is a shifted or offset ellipsoid as described above. The ellipsoid has two focal points: F1 and F2. The ellipsoid also has a center point C. The major axis 310 of the ellipse 308 is the line that includes F1 and F2. The minor axis 312 is perpendicular to the major axis 310 and intersects the major axis 310 at point C. To form the shifted ellipsoid, the focal points corresponding to the light sources 32 are moved outward from the major axis 310 and are shifted or rotated about the focal point F1. The ellipsoid is then rotated and a portion of the surface of the ellipsoid is used as a reflective surface. The angle may be various angles corresponding to the desired overall geometry of the device. In an ellipse, light generated at point F2 will reflect from a reflector at the outer surface 314 of the ellipse and intersect at point F1.

Figure 3B:
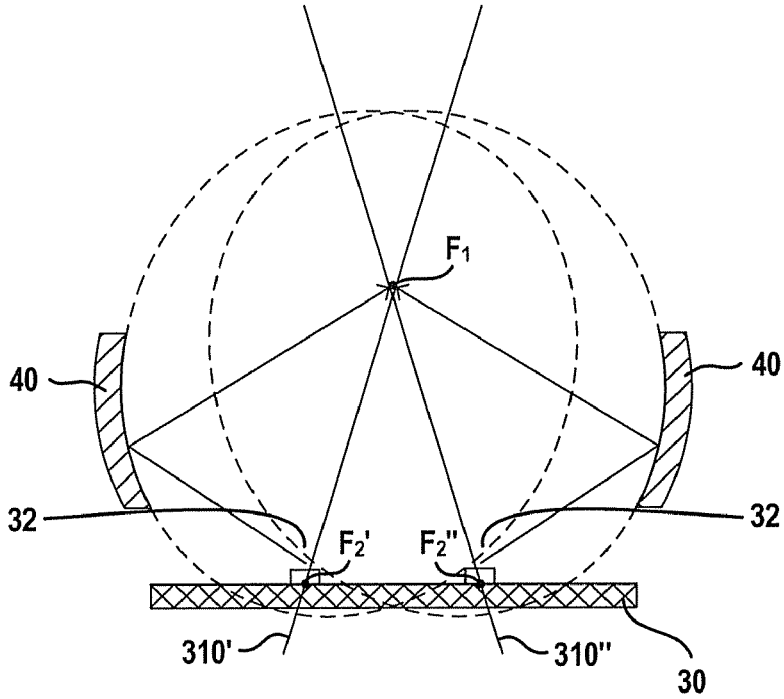

Referring now to FIG. 3B, the shifted or offset ellipsoid will reflect light from the focal points F2' and F2" to intersect on the focal point F1. The focal points F2' and F2" are on a ring of light sources 32 whose low-angle light is reflected from the shifted ellipsoid surface and the light is directed to focal point F1. The construction of the ellipsoid can thus be seen in FIG. 3B since the focal point F2 now becomes the ring that includes F2' and F2".

The reflector 40 can thus be described as a section having an ellipsoidal cross-section comprising a partial continuous rotated elliptical reflector having a first focal point within the cover 18 and a plurality of second focal points disposed in a continuous second ring coincident with a first ring intersecting the plurality of light sources. The partial continuous rotated ellipsoidal reflector reflects low angle light from the plurality of light sources toward the first focal point then through the cover. The reflector 40 is formed by rotating a major axis of an ellipse around the second ring while continually intersecting the first focal point.

Figure 4:
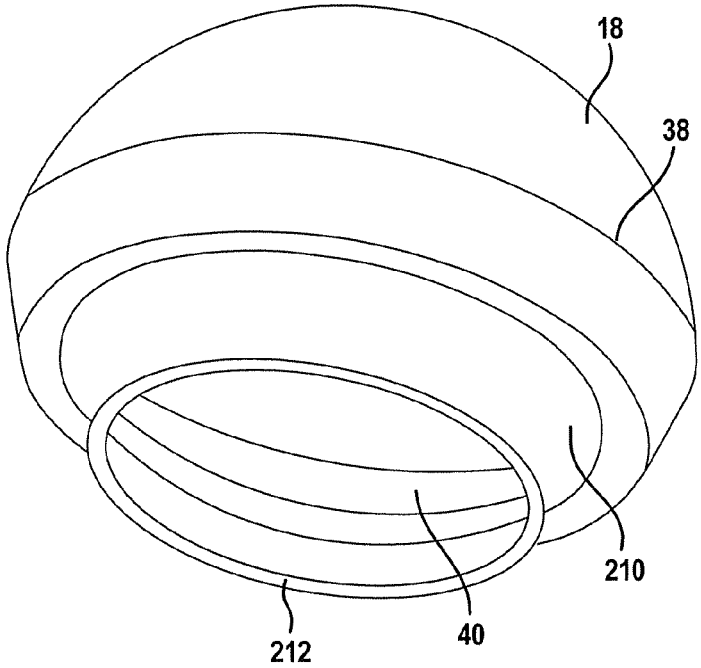
FIG. 4 is a perspective view of the cover.

Referring now to FIG. 4, the cover 18 is illustrated in further detail. The cover 18 has the spherical portion 38 and the reflector portion 40 formed therein. The cover 18 may also include a flange 410 that extends from the reflector portion 40. The flange 410 has a bottom surface or edge 212 that is directly adjacent to and contacts the housing 16. In one example, the edge 212 of the flange 410 is heat-staked to the housing 16. Adhesive may be used to couple the edge 212 of the flange 410 to the housing 16. In one example, the edge 212 may be coupled to the first portion 20 of the housing.

Figure 5:
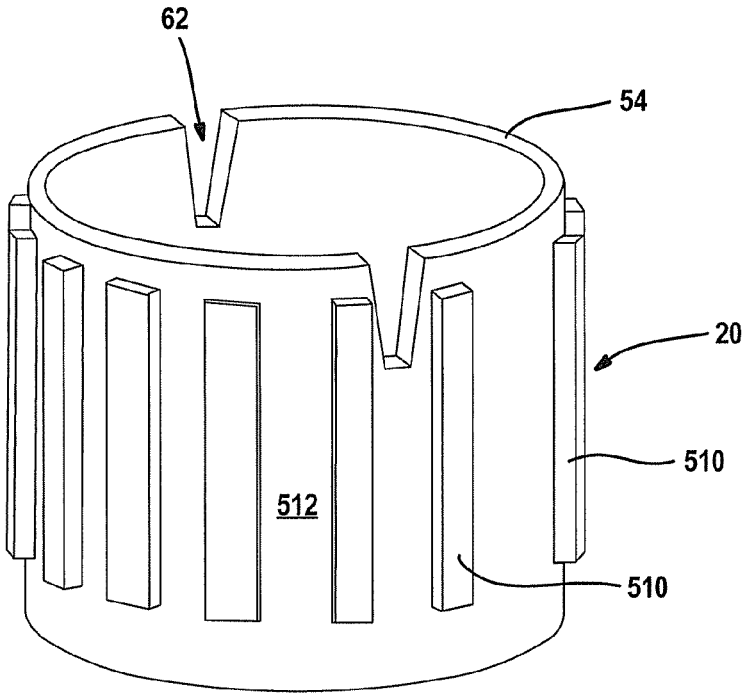
FIG. 5 is a perspective view of the first portion of the housing.

Referring now to FIG. 5, the first portion 20 of the housing 16 is illustrated in further detail. The first portion 20 may be cylindrical in shape. The cylindrical shape allows easy manufacturing by extrusion or another type of process. The first portion 20 in one constructed example is composed of aluminum which is both a thermally-conductive material and an electrically-conductive material. The tubular structure of the first portion 20 includes the inner wall 54 which defines the first volume 29 illustrated in FIG. 1. The tubular wall may have openings 62 therein for venting the heat within the volume 29 to the channels as described above.

The inner wall 54 may have first fin portions 510 extending therefrom. The fin portions 510 are used to form the channels 24 described above. The first fin portions 510 may not extend the length in a longitudinal direction of the inner wall 54. The spaces between the fin portions 510 illustrated by reference numeral 512 eventually become a portion of the channels.

Figure 6:
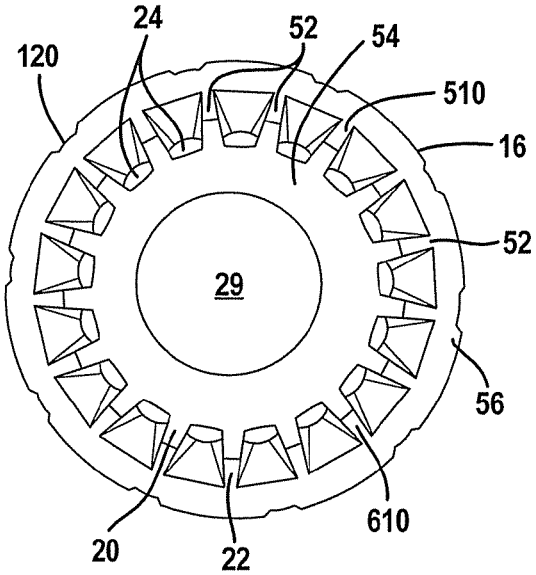
FIG. 6 is an end view of the housing closest to the cover.

Referring now to FIG. 6, a top view of the housing 16 is illustrated in further detail. The housing encloses the first volume 29. The housing 116 may have a first portion 20 and a second portion 22. As mentioned above, the first portion 20 may be formed of various materials including extruded aluminum. The first portion 20 may also contain first fin portions 510 that are partially used to define the fins 52. The fins 52 may also have a second portion 610 extending from the outer wall 56 of the housing 16. The second fin portions 610 extend radially inwardly and have an end or edge that directly abuts or is formed adjacent to an edge of the first portion 510 of the fins 52. A plurality of channels 24 is illustrated defined between the first portions 510, the second portion 610 of the fins 52 and the inner wall 54 and the outer wall 56 of the housing 16. As can be seen, the upper portion or the portion adjacent to the cover 18 has a larger cross-sectional area than the lower portion of the channel that is adjacent to the lamp base 14 illustrated in FIG. 1. In this example, the outer wall forms a tapered surface that reduces the cross-sectional area of the channel 24. In the multiple channels i, the relationship of the density of the air (ρ), velocity of the air (v) and area of the channel (a) in to out is determined by the formula:

$$\Sigma(\rho va)_{in}^{i}=\Sigma(\rho va)_{out}^{i}$$

Thus, as the air becomes less dense (heated) the velocity in the channel 24 increases. The air at the narrower outlet is faster than the air at the inlet causing the channel to have a nozzle effect.

The outer wall 56 may also contain channels 620 to increase the affectivity of the heat-sinking capability of the housing 16. As well as improving grip when changing the light assembly.

Figure 7:
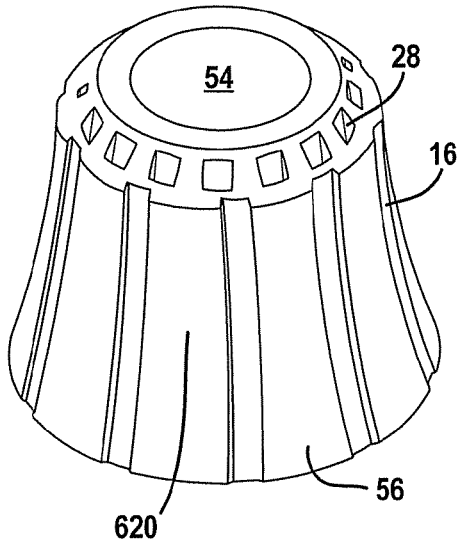
FIG. 7 is a perspective view of the housing.

Referring now to FIG. 7, an external view of the housing 16 is illustrated. In this view, the outlet ports 28 of the channels 24 are clearly shown at the portion of the housing 16 closest to the lamp base, when assembled. The air within the channels 24 is heated as it travels through the channels and is emitted from the exit or outlet 28.

Figure 8:
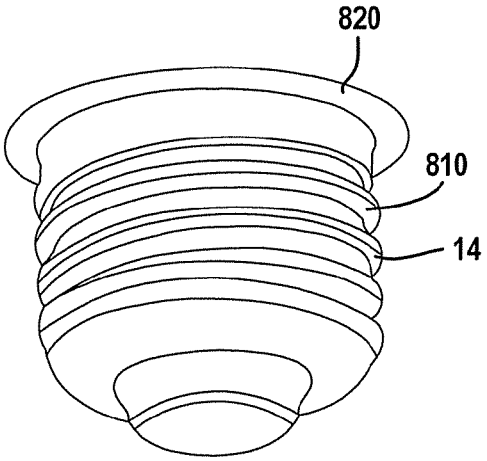
FIG. 8 is a perspective of the lamp base.

Referring now to FIG. 8, the lamp base 14 is illustrated in further detail. The lamp base 14 in this example includes threads 810. The lamp base 14 illustrated is referred to as an Edison base. However, other types of bases may be included within the device.

The lamp base 14 also includes a flange 820. The flange 820 may be used to secure the lamp base 14 within the housing 16 illustrated above. The lamp base 14 may be molded to the housing when the second portion of the housing 16 is formed. In this manner, the lamp base 14 will be affixed to the housing 16. Of course, other types of affixing may be performed including adhesives or fasteners.

Figure 9A:
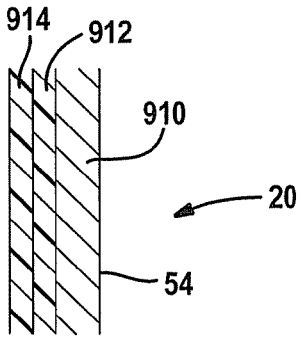
FIG. 9A is a partial cross-sectional view of the first portion of the housing.

Referring now to FIG. 9A, a cross-sectional view of the first portion 20 of the housing 16 is illustrated. In this example, the first portion 20 may be formed of a metal layer 910 such as aluminum. Various other layers 912 and 914 may be formed thereon. The thermal conductivity of the layers 910-912 may be varied. Layers 912 and 914 may be physically molded layers or may be coated layers formed on the metal layer 910. For example, nano structures could be used as an outer layer.

Figure 9C:
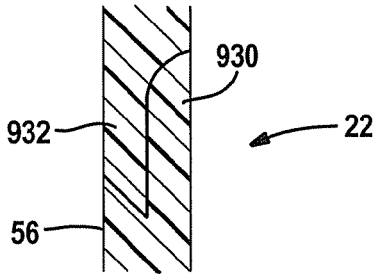
FIG. 9C is a partial cross-sectional view of the second portion of the housing.
Figure 9B:
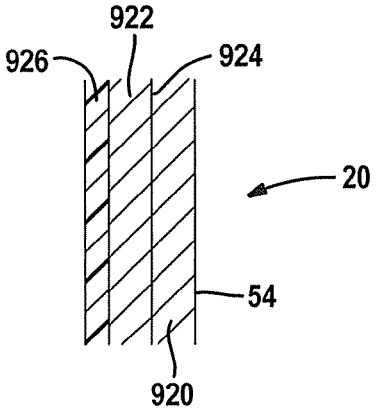
FIG. 9B is an alternative cross-sectional view of the first section of the housing.

Referring now to FIG. 9B, cross-sectional view of the first portion 20 of the housing 16 is illustrated in a different example. In this example, two metal layers 920 and 922 are placed adjacent thereto. A thermal transfer layer 924 may be disposed between the two metal layers of first portion 20. Thermal grease or another type of thermal transfer medium may be formed therebetween. The layer 920 may be a tube structure for increased thermal conduction. The layer 920 may be used in high wattage lighting.

A coating or a plastic layer 926 may also be formed on the second metallic layer 922. Each of the layers may have a different thermal conductivity.

Referring now to FIG. 9C, a cross-sectional view of a portion of the second portion 22 of the housing 16 is illustrated. In this example, two different plastic layers 930 and 932 are set forth. In this example, two different thermally conductive materials are used in the different layers 930 and 932. The plastic layers 930 and 932 also illustrate the use of a thermally-conductive plastic 930 disposed adjacent to a thermally non-conductive or reduced thermally conductive layer 932. As mentioned above, heat is transferred longitudinally downward toward the base 14. Thus, thermal conductivity is more important closer to the lamp base 14. Thermally-conductive plastic is expensive and thus may be minimized. Therefore, the thermally-conductive plastic may be used at the end of the channel 24 adjacent or proximate the lamp base 14 and non-thermally conductive plastic 932 may be used closer to the inlet or cover 18. This is illustrated by the discontinuity of the layers.

Figure 9D:
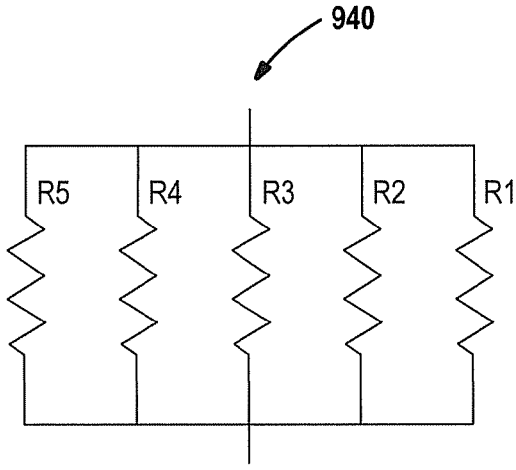
FIG. 9D is a circuit illustrating the thermal resistance of the housing.

Referring now to FIG. 9D, the various layers of the housing may act as parallel formal resistors illustrated by the circuit 940 in FIG. 9D. In this example, the thermal resistances R1, R2, R3, R4, and R5 are illustrated in parallel. In this example, layers R1, R2 and R3 may correspond to layers 910, 912 and 914 illustrated in FIG. 9A. The thermal resistances R4 and R5 may correspond to layers 930 and 932 in FIG. 9C. The effective length of the thermal path L and the area of the thermal path A allows the thermal resistance of the channels to be provided by the formula: $R_{eff}=(L/A)(1/(K_5+K_{5'}))$.

The additive nature of the thermal conductivity's $K_5+K_{5'}$ with the concentric layers act like parallel thermal resistors to reduce the effective thermal resistance of the system. This is a unique solution to obtain a higher wattage of illumination in a small package. Pyrolitic graphite may also be used as a layer in either of the housing portions to shield electromagnetic radiation from a driver circuit board.

Figure 10:
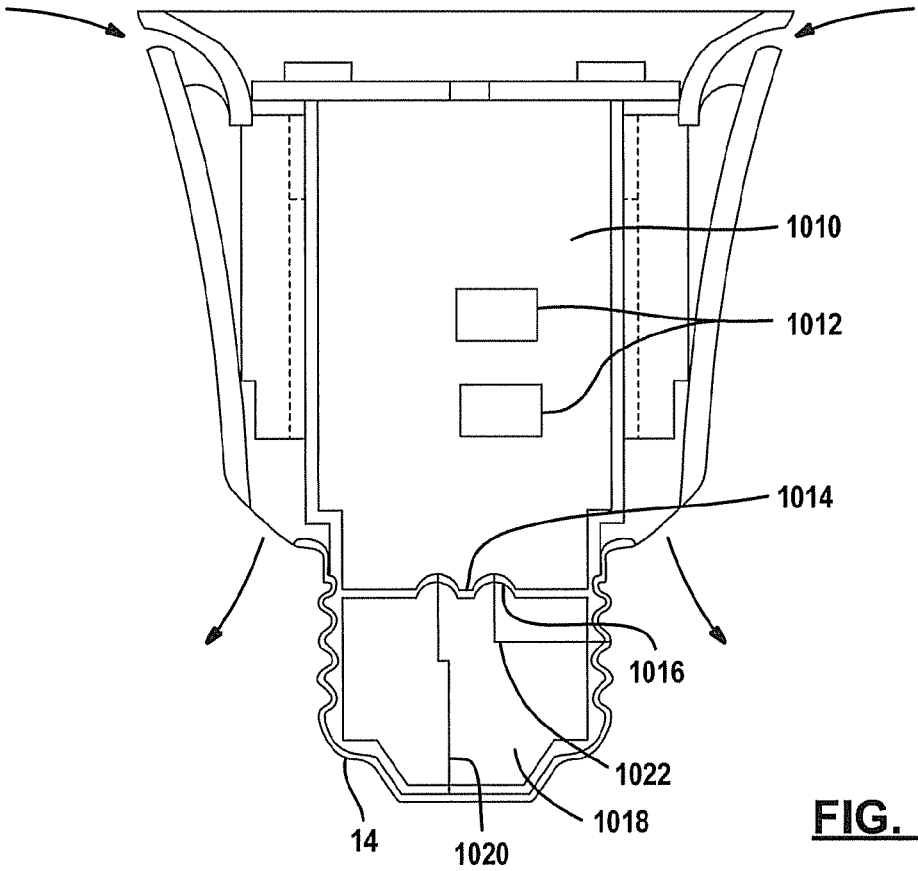
FIG. 10 is a cross-sectional view of the lower portion of the light assembly having a control circuit board therein.

Referring now to FIG. 10, a control circuit board 1010 may also be included within the volume 29 of light assembly 10. The control circuit board 1010 is illustrated as planar. Different examples of the circuit board 1010 may be implemented, such as a cylindrical or longitudinally-oriented circuit board. The circuit board 1010 may be various shapes.

The control circuit board 1010 may include various control chips 1012 that may be used for controlling various functions of the light sources 32. The control chips 1012 may include an alternating current (AC) to direct current (DC) converter, a dimming circuit, a remote control circuit, discrete components such as resistors and capacitors, and a power circuit. The various functions may be included on an application-specific integrated circuit. Although only one control circuit board 1010 is illustrated, multiple circuit boards may be provided within the light assembly 10.

The circuit board 1010 may have a connector 1014. The connector 1014 may couple a connector 1016 of an AC input board 1018. The AC input board 1018 may be located in the lamp base circuit traces 1020, 1022 may provide AC voltage to the connector 1016 which, in turn, provides AC voltage to the connector 1014 and to the circuit board 1010.

Figure 11:
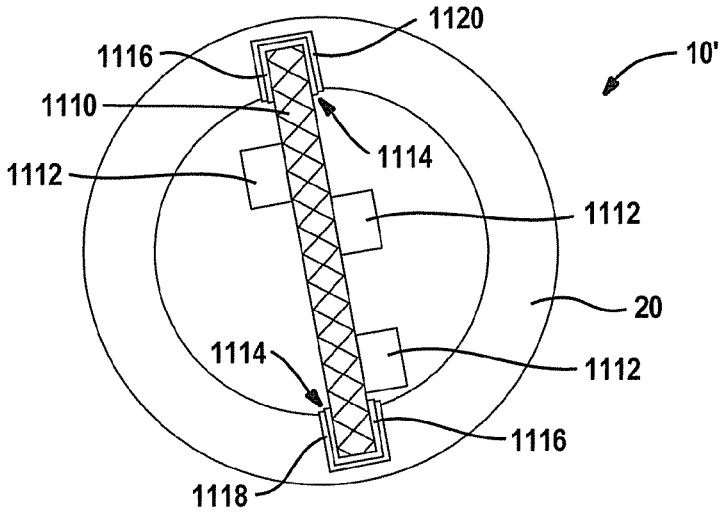
FIG. 11 is an alternative view of a circuit board disposed in the light assembly.
Figure 12:
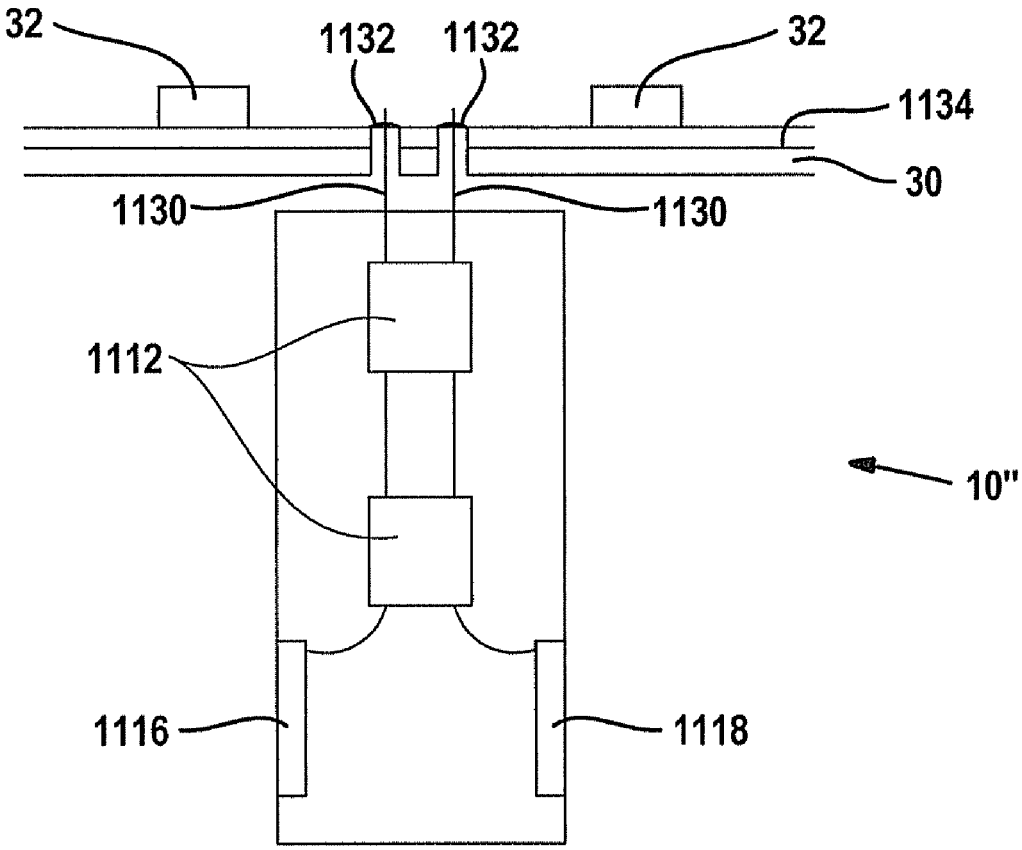
FIG. 12 is a cutaway view of the control circuit board within the light assembly.

Referring now to FIGS. 11 and 12, another example of a light assembly 10' is illustrated. This example is similar to that of FIG. 10 illustrated above and thus common components will be labeled the same. In this example of the light assembly 10', an alternative example of the control circuit board 1110 is illustrated. The control circuit board 1110 may include various electrical components forming the controls for the light assembly. The electrical components 1112 may be affixed to one or more sides of the circuit board 1110. The components 1112 may be various types of components as those described above, including an AC to DC converter, resistors, electrical chips, capacitors, and other elements.

The circuit board 1110 may fit within housing 16. The fit may be an interference fit between the housing 16 and the circuit board 1110. More specifically, a pair of grooves 1114 may be formed laterally across the housing 16 from each other so that the circuit board 1110 may be accepted therein. As is best illustrated in FIG. 12, the circuit board 1110 may include edge connectors 1116, 1118 for electrically coupling to opposite polarities within housing 16. The interference fit within the grooves 1114 may be used to insure an electrical connection between the edge connectors 1116, 1118 and contacts 1120 disposed within the grooves 1114.

As is best illustrated in FIG. 12, the circuit board 1110 may include wires 1130 extending therefrom. The wires 1130 may be used to provide power to the light sources 32 on the circuit board 30. Solder material 1132 may be used to join the wires 1130 to circuit traces 1134 disposed on the circuit board 30. In addition to solder material 1132, other materials for joining the wires 1130 to the circuit traces 1134 may be evident to those skilled in the art. For example, conductive inks or adhesives may also be used. Wire bonding is another method for joining the wires 1130 to the circuit traces 1134.

The example illustrated in FIGS. 11-12 has a manufacturing advantage. The circuit board 1110 may then be inserted into the grooves 1114 so that the contacts 1120 are electrically coupled to the edge connectors 1116 and 1118. Various configurations of electrical contacts may be used. What is important is that electricity is provided from the base 14 to the control circuit board 1110.

Figure 13:
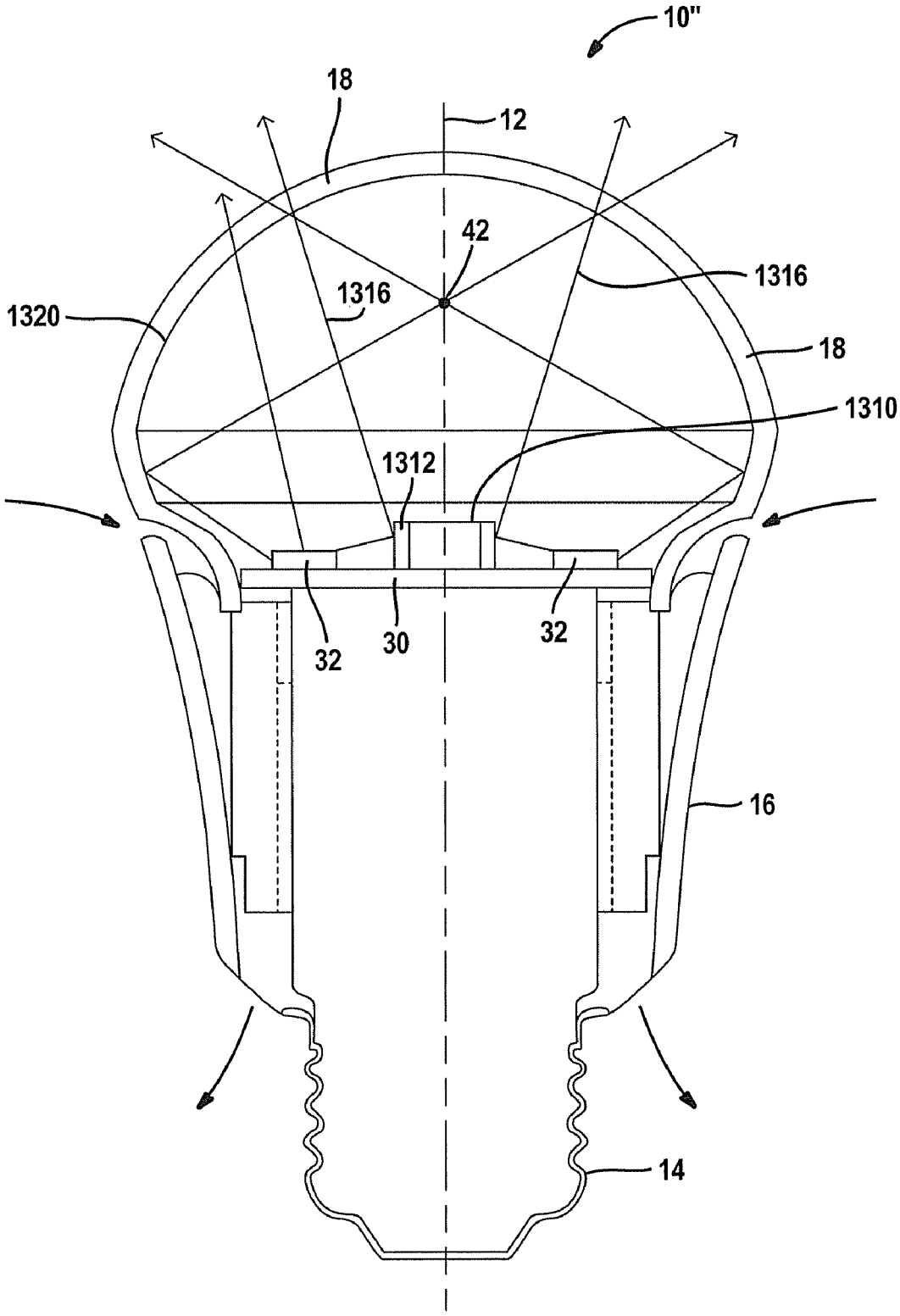
FIG. 13 is a cross-sectional view of an alternative example having a light-shifting element disposed within the second volume of the cover.

Referring now to FIG. 13, an alternate example of the light assembly 10" is set forth. In this example 10" a light-shifting element 1310 is disposed on the circuit board 30. The light-shifting element 1310 may reflect low-angle light emitted from the light sources 32. The light-shifting element 1310 may have a coating 1312 or be made of other material that shifts the wavelength of light emitted 1316 from the light sources 32 to another wavelength. This may allow the overall output of the third example of the light assembly 10" to have a tuned wavelength output. A film or coating is used to shift the wavelength from a first wavelength to another wavelength. The particles or elements within the light-shifter may be tuned as desired. The tuning may be performed depending upon the expected application for the light assembly.

In addition to or in replacement of the light-shifter 1310, a light-shifting film 1320 may extend across the light cover 18. The film 1320 may be formed of a material to perform light-shifting. For example, the light sources 32 may emit blue light while the light-shifting film 1320 may change the light to other wavelengths so that white light is emitted from the light film 1310. It should be noted that a gradient may also be formed on the film. A gradient may include more light-shifting toward the middle or center 42 of the light assembly and light less light-shifting toward the cover 18. That is, the light-shifting rate may be a first rate adjacent to the cover 18 and a second rate more than the first rate near the center 42 of the cover 18. The position of the film relative to the circuit board 30 may vary along the longitudinal axis 12 depending on the amount of light to be shifted. If less light is desired to be shifted, the film may be suspended closer to the top of the cover 18 away from the base 14. If more light is desired to be shifted, the light shifter 1320 may be suspended across the cover 18 closer to the junction of the housing and the cover 14.

Figure 14:
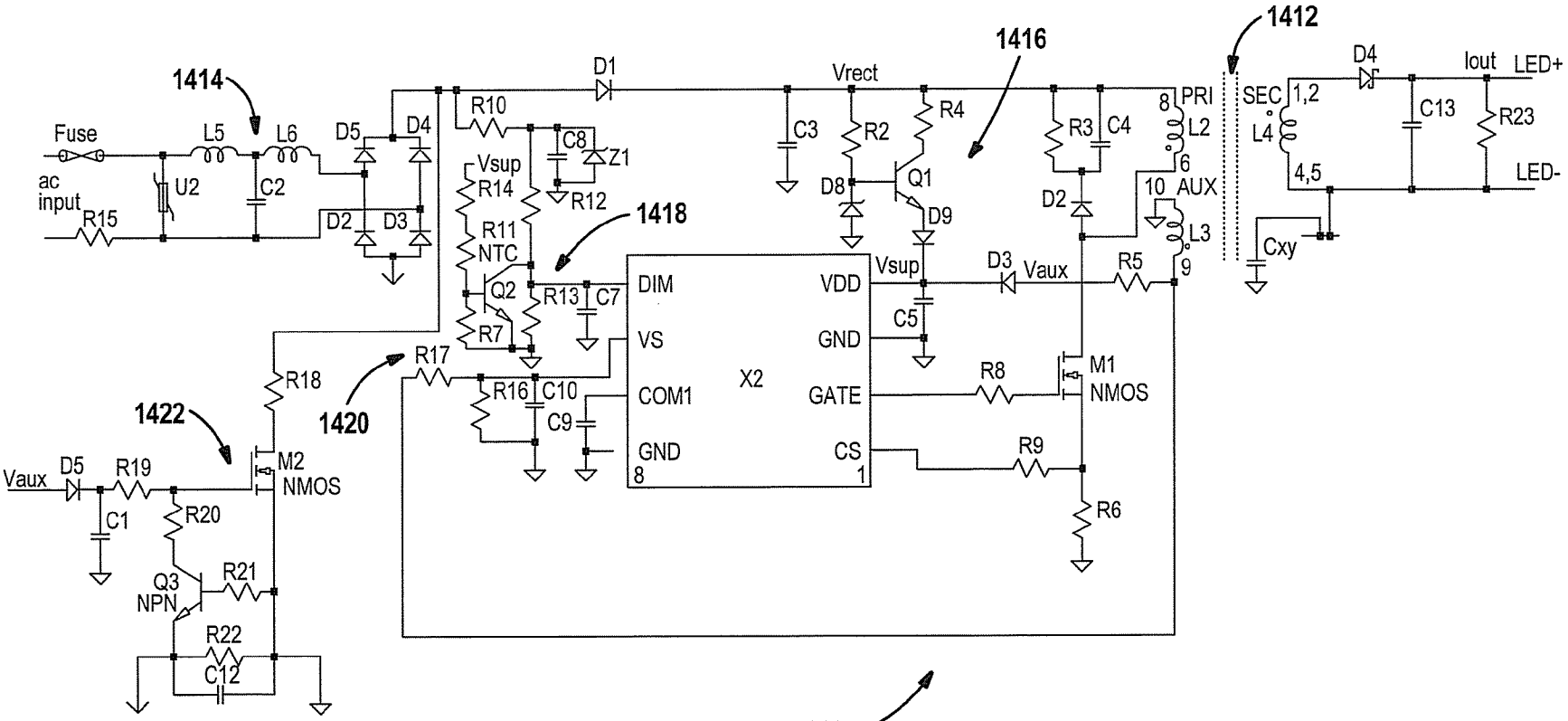
FIG. 14 is a schematic view of an AC to DC converter formed according to the present disclosure.

Referring now to FIG. 14, one example of AC to DC converter 1410 is illustrated using a primary side control circuit. In this example, a flyback topology with a primary side (PRI) of transformer 1412 feedback is set forth. Integrated circuit X2 is a Fairchild 7730 is an off-the-shelf driver IC which includes overvoltage protection by sensing the reflected voltage on the AUX terminal, output short protection by limiting the max primary side current, and over-temp protection.

The FL7730 circuit chip is a single-stage primary-side-regulation pulse width modulated (PWM) controller for LED dimmable driving. Dimming is performed using a triode for alternating current (TRIAC) that is controlled for smoothly managing brightness control without flicker using a single-stage topology with primary-side regulation. Constant on-time control may be utilized through an external capacitor connected to the COMI pin which, in this case, is capacitor C9. The pinouts of the circuit are current sense (CS) which connects a current-sense resistor to a MOSFET current for the output-current regulation in constant-current regulation. The gate pin is a pulse-width modulated signal output which uses an internal totem-pole output driver to drive the power MOSFET. The MOSFET used in this example is M1. The ground GND pin is ground for the integrated circuit. VDD is the power supply which provides the operating current and MOSFET driving current. The dimming pin (DIM) controls the dimming operation of the LED lighting. A voltage sense pin (VS) detects the output voltage information and discharge time for frequency control and constant-current regulation. This pin connects the divider resistors from the auxiliary winding. A constant-current loop compensation (COMI) is the output of the transconductance error amplifier. Ground is also provided on pin 8 of the integrated circuit.

The high power factor is maintained throughout the complete dimming range by maintaining the switcher in discontinuous conduction mode or boundary condition mode. This is achieved by X2 and sensed by R17,R6,C10 which is a ratio of the AUX voltage.

An EMC filter 1414 is provided to meet IEEE C62.41 (surge transients) requirements and conducted emissions is achieved by a T-filter comprised of L5, L6 and C2, which is a low pass filter to the AC input, and a low pass filter to the incoming voltage transients. R15 is a current limit resistor to limit the max inrush at the trailing edge of the TRIAC M2 when at the maximum input voltage, and also serves to limit the current through the varistor U2 during the surge transients which allows the use of a smaller fuse.

A voltage regulator 1416 formed using Q1, D8 turns on when the auxiliary voltage Vaux goes below the IC startup voltage, and provides the voltage needed for startup when the lamp is turned off at any dim level, as long as the input RMS voltage exceeds the startup voltage. Resistors R4 and R5 are used to limit current transients during the charging of capacitor C5.

The dimming circuit 1418 consists of a low pass filter-divider which converts the TRIAC voltage to a corresponding analog voltage. Zener diode Z1 limits the max LED current during system overvoltage conditions by clamping the max analog voltage. A thermal foldback circuit 1420 having Q2, R14, R7 is used for biasing, and temperature sensing using a temperature sensor such as negative temperature coefficient resistor (NTC) or thermistor R11. The NTC R11 can be remotely located at a thermal hot spot within the lamp assembly so that after the temperature exceeds a predetermined threshold determined by the divider R14, R11, R7, the voltage at DIM pin (circuit 1418) will be uniformly scaled back or reduced. This lowers the LED current (and corresponding light output) to a minimum level but not fully turning off the LEDs so light output is still generated from the light assembly. By reducing the LED current the heat dissipated by the light assembly is also reduced. The LED will return to full output when the temperature as sensed by R11 decreases below the threshold.

To ensure the TRIAC has a continuous minimum load, an active bleeder circuit 1422 is included by way of R18. When TRIAC M2 is conducting (on) R18 is pulled in when the current draw drops below 15-20 mA. This is achieved by the voltage drop through R22 and base current through R21. During the off-time (non-conducting state) of the TRIAC M2, the auxiliary voltage will keep the R18 pulled in which provides a DC path for the TRIAC hold current. This eliminates TRIAC misfires at all dimmer levels. C12 in-series with C3 bypasses the current spikes during the trailing edge of the TRIAC which prevents Q3 from conducting during transients.

Although many components are illustrated as discrete components, the functions of the integrated circuit as well as many of the components therearound may be formed using an application-specific integrated circuit (ASIC). The application-specific integrated circuit may exclude the TRIAC M2.

The foregoing description of the examples has been provided for purposes of illustration and description. It is not intended to be exhaustive or to limit the invention. Individual elements or features of a particular example are generally not limited to that particular example, but, where applicable, are interchangeable and can be used in a selected example, even if not specifically shown or described. The same may also be varied in many ways. Such variations are not to be regarded as a departure from the invention, and all such modifications are intended to be included within the scope of the invention.

What is claimed is:

1. A light assembly comprising:

a cover;

a base;

a housing coupled between the cover and the base;

a first circuit board disposed within the housing, said first circuit board having a plurality of light sources thereon;

said housing comprising an inner wall defining a first volume therein and an outer wall spaced apart from the inner wall, said housing comprising a plurality of spaced apart fins extending between the inner wall and the outer wall define a plurality of channels having a first end proximate the cover and a second end proximate the base, said channels have a first cross sectional area proximate said first end greater than a second cross-sectional area proximate the second end; and an elongated control circuit board assembly electrically coupled to the light sources of the first circuit board and the base, said control circuit board having a plurality of electrical components thereon for controlling the light sources.

2. The light assembly as recited in claim 1 wherein said housing comprises a first portion and a second portion, said first portion comprising a first plurality of spaced apart fin portions extending radially outward from the inner wall; and said second portion comprising a second plurality of spaced apart fin portions extending inward from the outer wall, said first plurality of fin portions directly adjacent to the second plurality of fin portions so that said first plurality of fin portions, said second plurality of fin portions form the plurality of fins, and said first plurality of fin portions, said second plurality of fin portions, the outer wall and the inner wall form the plurality of channels.

3. The light assembly as recited in claim 2 wherein the first portion has a first thermal conductivity and said second portion has a second thermal conductivity less than the first thermal conductivity.

4. The light assembly as recited in claim 2 wherein the second portion is composed at least partially of thermally conductive plastic.

5. The light assembly as recited in claim 2 wherein the first portion is composed of and electrically conductive material and thermally conductive material.

6. The light assembly as recited in claim 2 wherein the first portion comprises a plurality of layers at least two of which have different thermal conductivities.

7. The light assembly as recited in claim 2 wherein the first portion comprises a plurality of layers at least two of which have different thermal conductivities.

8. The light assembly as recited in claim 1 further comprising a tube adjacent to the inner wall.

9. The light assembly as recited in claim 1 wherein said cover and said first circuit board defining a second volume separated from said first volume, said first circuit board having a port therethrough for linking the first volume and the second volume.

10. The light assembly as recited in claim 9 wherein the housing comprises an opening therethrough, said opening linking the first volume and at least one of the plurality of channels.

11. The light assembly as recited in claim 1 wherein the cover comprises a monolithic partial ellipsoidal cross-sectional area portion and a spherical portion.

12. The light assembly as recited in claim 11 wherein the ellipsoidal cross-sectional-area portion reflects light from the plurality of light sources to a center point of the spherical portion.

13. The light assembly as recited in claim 11 wherein the ellipsoidal cross-sectional area portion is adjacent to a flange which is adjacent to the housing.

14. The light assembly as recited in claim 11 wherein the light sources are disposed in a first ring around a longitudinal axis of the light assembly.

15. The light assembly as recited in claim 14 wherein the partial ellipsoidal cross-sectional area comprises a partial continuous rotated elliptical reflector having a first focal point within the cover and a plurality of second focal points disposed in a continuous second ring coincident with the first ring intersecting the plurality of light sources, said partial continuous rotated elliptical reflector reflecting low angle light from the plurality of light sources toward the first focal point then through the cover.

16. The light assembly as recited in claim 15 wherein the reflector comprises a partial ellipsoid formed by rotating a major axis of an ellipse around the second ring while continually intersecting the first focal point.

17. The light assembly as recited in claim 1 wherein the control circuit board is aligned with a longitudinal axis of the housing.

18. The light assembly as recited in claim 1 further comprising a light-shifting element coupled to the circuit board, said light-shifting element receiving light from the plurality of light sources at a first wavelength and reflecting light at a second wavelength different that the first wavelength.

19. The light assembly as recited in claim 1 further comprising a thermally conductive interface coupling the circuit board to the housing.

20. The light assembly as recited in claim 1 wherein the plurality of light sources comprises a plurality of light emitting diodes.

21. The light assembly as recited in claim 1 wherein the elongated control circuit board comprises a dimming circuit for controlling the plurality of light sources.

22. The light assembly as recited in claim 21 wherein the dimming circuit comprises a primary side control circuit that comprises a thermal foldback circuit reducing a dimming voltage when a temperature of a temperature sensor exceeds a predetermined temperature.

23. A light assembly as recited in claim 21 wherein the dimming circuit comprises a primary side control circuit that comprises a thermal foldback circuit uniformly reducing a dimming voltage to the light sources when a temperature of a temperature sensor exceeds a predetermined temperature.

* * * * *